US006272802B1

(12) United States Patent
Berberich

(10) Patent No.: US 6,272,802 B1
(45) Date of Patent: Aug. 14, 2001

(54) MODULAR CONSTRUCTION SYSTEM

(76) Inventor: Karl Berberich, 26 Hickory La., Safety Harbor, FL (US) 34695

( * ) Notice: Subject to any disclaimer, the term of this patent is extended or adjusted under 35 U.S.C. 154(b) by 0 days.

(21) Appl. No.: 09/443,268

(22) Filed: Nov. 18, 1999

(30) Foreign Application Priority Data

Oct. 9, 1998 (HN) ..... PI/HN98/160

(51) Int. Cl.[7] ..... E04B 1/10; E04B 1/38

(52) U.S. Cl. ..... 52/233; 52/282.1; 52/586.1; 52/592.6; 52/775; 52/780

(58) Field of Search ..... 52/233, 282.1, 52/282.4, 586.1, 586.2, 592.6, 775, 780

(56) References Cited

U.S. PATENT DOCUMENTS

| | | | | |
|---|---|---|---|---|
| 794,595 | * | 7/1905 | Ducker | 52/282.4 X |
| 2,021,341 | * | 11/1935 | Ward | 52/233 |
| 3,979,862 | * | 9/1976 | Hamilton et al. | 52/233 X |
| 4,567,701 | * | 2/1986 | Biggs et al. | 52/233 |
| 4,577,444 | * | 3/1986 | Sanderson | 52/775 X |
| 4,590,729 | | 5/1986 | Hegazi . | |
| 4,685,829 | | 8/1987 | Matiere . | |
| 4,712,352 | | 12/1987 | Low . | |
| 4,742,657 | * | 5/1988 | Veech | 52/233 |
| 5,359,825 | | 11/1994 | Makarov . | |
| 5,577,356 | * | 11/1996 | Hubbard et al. | 52/233 |
| 5,609,003 | | 3/1997 | Jouty . | |
| 5,638,651 | | 6/1997 | Ford . | |
| 5,643,488 | | 7/1997 | Lee . | |
| 5,864,997 | * | 2/1999 | Kelly | 52/586.1 X |

FOREIGN PATENT DOCUMENTS

| | | | | |
|---|---|---|---|---|
| 12427 | * | 9/1977 | (AU) | 52/233 |
| 75780 | * | 6/1976 | (GB) | 52/233 |
| 2-197638 | * | 8/1990 | (JP) | 52/233 |
| 3-224929 | * | 10/1991 | (JP) | 52/233 |
| 6-73810 | * | 3/1994 | (JP) | 52/233 |
| 36668 | * | 1/1923 | (NO) | 52/233 |

* cited by examiner

*Primary Examiner*—Laura A. Callo
(74) *Attorney, Agent, or Firm*—Holland & Knight LLP

(57) ABSTRACT

The present invention relates to a modular building system. The system employs various building elements, which are interconnected by way of scarf joints. The building elements are connected to form a building module. The modules, in turn, can be interconnected to form a larger structure such as a dwelling. Additionally, the present system allows fixtures, such as window and door frames, to be incorporated into a completed dwelling. The details of the various components of the system of the present invention, and the manner in which they interrelate, will be described in greater detail hereinafter.

9 Claims, 9 Drawing Sheets

MODULAR CONSTRUCTION SYSTEM

CROSS REFERENCE TO RELATED APPLICATIONS

This application claims priority from Honduran application number PI/HN98/160, filed Nov. 19, 1998.

BACKGROUND OF THE INVENTION

1. Field of the Invention

This invention relates to a modular building system, and more particularly pertains to a building system employing interlocking construction elements.

2. Description of the Related Art

The world population has grown at an exponential rate in recent decades. One of the biggest problems created by surging population figures is housing. An even bigger problem is the absence of affordable housing. Housing costs are typically driven by two factors: the cost of building materials; and the cost of labor. The cost of labor, in turn, is dictated by the time necessary to build a structure and the skill level of the laborers. One of the many efforts to decrease housing costs comes in the form of modular housing. Through modular housing, both material costs and labor costs can be drastically reduced.

Often times these modular systems utilize concrete or mortar slabs in constructing the final product. Examples of such systems include U.S. Pat. Nos. 5,359,825 to Makarov; U.S. Pat. No. 5,643,488 to Lee; U.S. Pat. No. 4,712,352 to Low; and U.S. Pat. No. 4,590,729.

Other efforts at modular systems employ multiple disconnectable fasteners or elaborate tongue-in-groove systems. Examples of these efforts include U.S. Pat. Nos. 5,609,003 to Jouty and U.S. Pat. No. 5,638,651 to Ford. Still yet other modular systems are primarily designed for structures other than dwellings. An example of such is U.S. Pat. No. 4,685,829 to Matiere.

While each of these modular systems achieves its particular objective, they all have a common result: a modular structure that looks modular.

Therefore, it is an object of this invention to provide an improvement which overcomes the aforementioned inadequacies of the prior art devices and provides an improvement which is a significant contribution to the advancement of modular home construction.

Another object of this invention is to enable modular construction systems to produce dwellings with a non-modular appearance.

Another object of the present invention is to permit a dwelling to be constructed from building elements that are easily interconnected.

Yet another object of the present invention is to provide a modular system which comprises individual building elements which are inexpensive and easy to manufacture.

Still yet another object of the present invention is to create a modular construction system that allows for the modular incorporation of doors and windows at desired locations.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, this invention comprises a modular building system employing interlocking building elements. Through the use of the system dwellings can be easily constructed and maintained.

The system employs many different building elements, one of which is a fastening piece. This fastening piece has a scarf joint formed within a forward edge of the piece running the entire length of the first surface.

First and second assembly pieces constitute additional building elements of the system. Each of the pieces includes a first scarf joint formed proximate a rearward edge of the piece which runs the length of the outer surface. Likewise, a second scarf joint is formed proximate the forward edge of the piece and runs the length of the inner surface. Additionally, a transverse scarf joint is formed perpendicular to the second scarf joint and runs the entire width of the first end. This transverse scarf joint is interconnected to the first end of the fastening piece. In a similar fashion, the transverse scarf joint of the second assembly piece is interconnected to the second end of the fastening piece.

Additional building elements are present in the form of a series of panels. Each of the panels is defined by a rounded forward surface and a planar rearward surface. The panels additionally include upstanding upper and side edges, and a lower scarf joint. The panels are adapted to be slid in between the first and second assembly pieces, with the upstanding side edges being received within the second scarf joints of the assembly pieces and with the upstanding upper edge of each panel being positioned within the scarf joint of the adjacent panel. In this manner a fluid tight seal is created between adjacent panels.

Finally, a second fastening piece is secured to the second ends of the first and second assembly pieces with the series of panels secured therebetween. The first and second assembly pieces, the first and second fastening pieces, and the series of panels thus form a complete modular unit. An elongated joining piece can be secured within the facing first scarf joints of adjacent assembly pieces to permit the coupling of adjacent modular units.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a modular building system. The system employs various building elements, which are interconnected by way of scarf joints. The building elements are connected to form a building module. The modules, in turn, can be interconnected to form a larger structure such as a dwelling. Additionally, the present system allows fixtures, such as window and door frames, to be incorporated into a completed dwelling. The details of the various system components, and the manner in which they interrelate, will be described in greater detail hereinafter.

Figure 1:
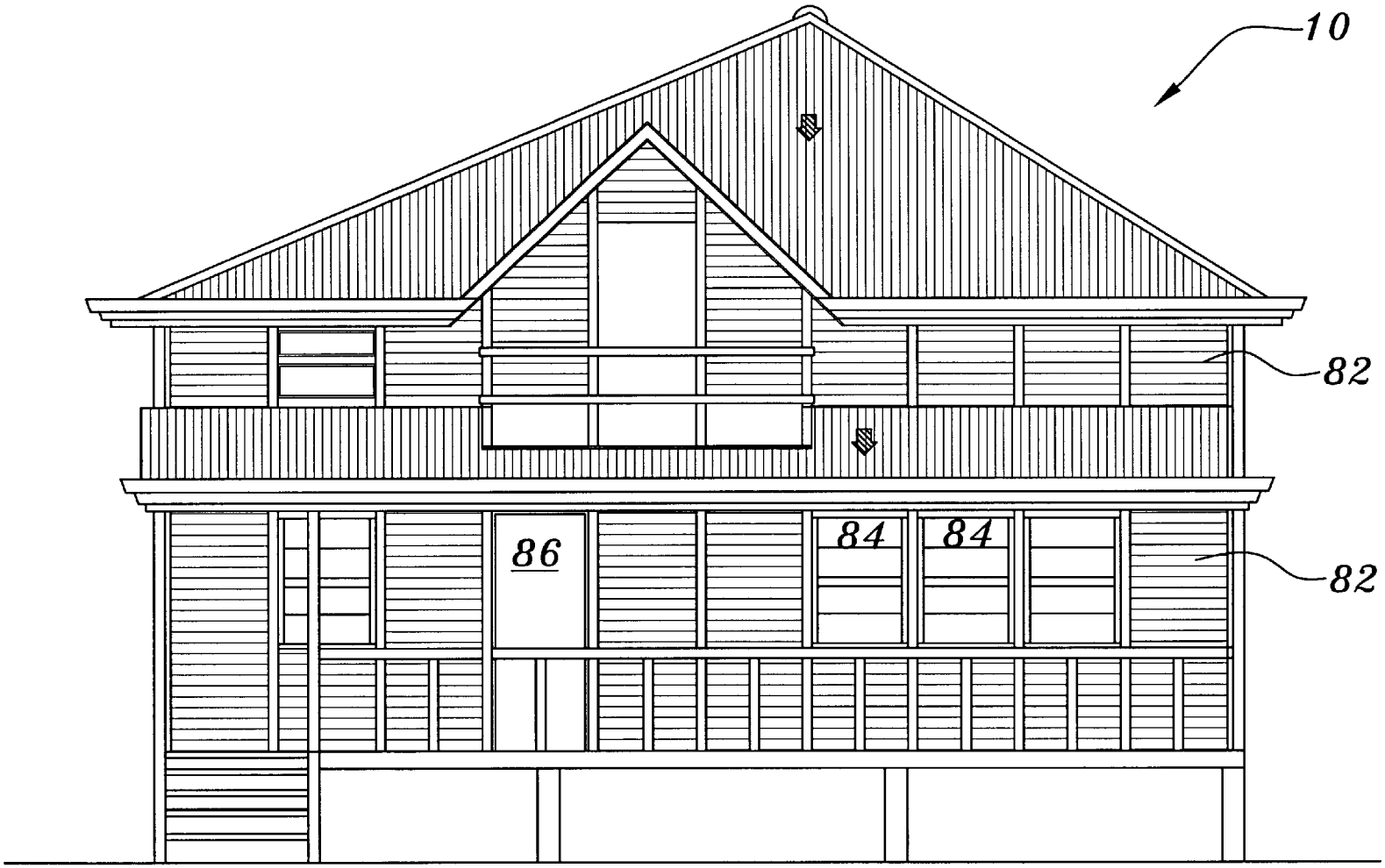
FIG. 1 is a front elevational view of a dwelling constructed from the modular system of the present invention.
Figure 2:
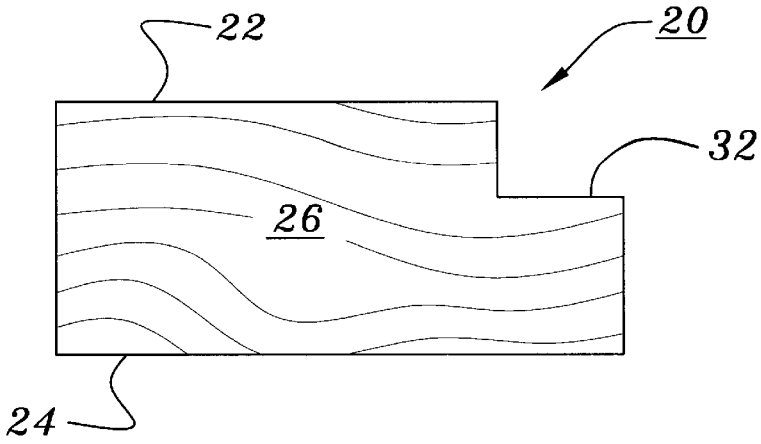
FIG. 2 is an elevational view of one fastening piece of the system.
Figure 3:
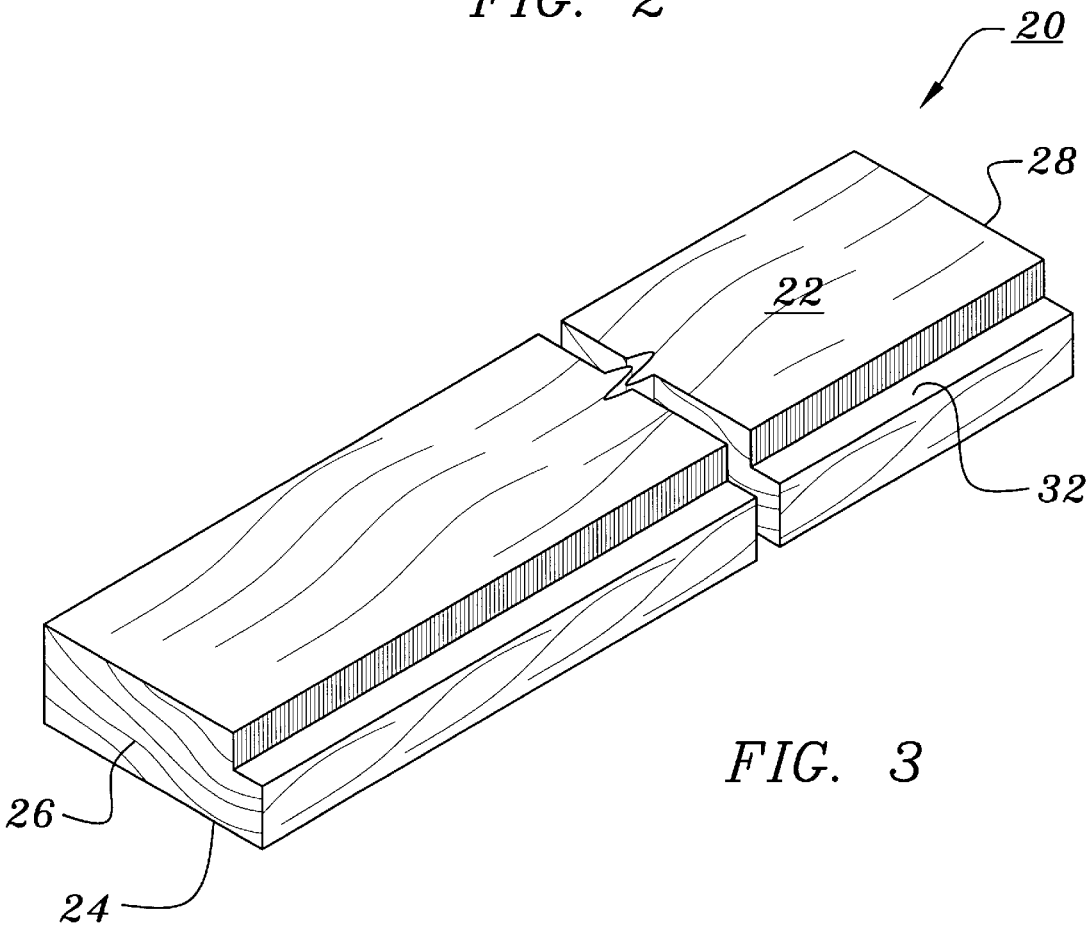
FIG. 3 as is a perspective view of one fastening piece of the system.

FIG. 1 illustrates a dwelling construction 10 in accordance with the system of the present invention. The entire structure 10 is formed from modular units. The modular units, in turn, are formed from interlocking building elements. These elements include: fastening pieces; assembly pieces; panels; and joining pieces. Each of the fastening pieces 20 are defined by first and second surfaces (22 and 24 respectively), and first and second ends (26 and 28 respectively). With reference to FIGS. 2–3, the scarf joint 32 of the fastening piece 20 is depicted. In the preferred embodiment, this scarf joint 32 is formed within a forward edge of the fastening piece 20 and runs the entire length of the first surface 22. The preferred nominal dimensions of the fastening piece are as follows: 2 inches in height; 4 inches wide; 2 feet 10 inches in depth; with the scarf joint measuring ½ inch wide and ½ inch high. Fastening pieces with differing dimensions, however, can be employed.

Figure 4:
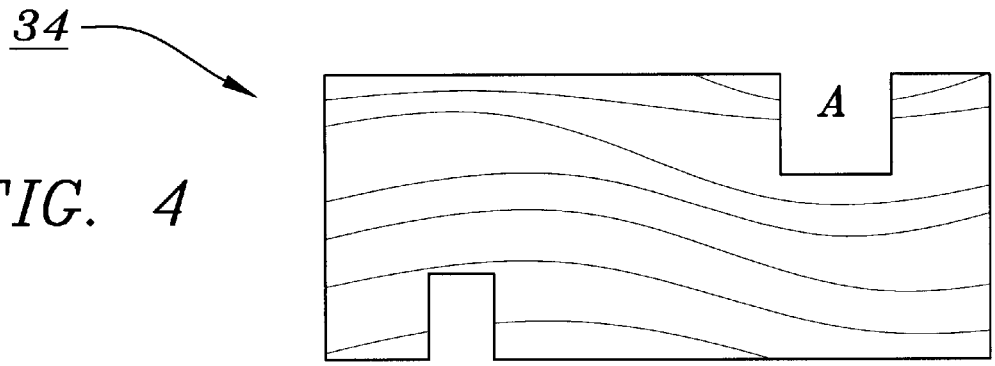
FIG. 4 is an elevational view of one assembly piece of the system.
Figure 5:
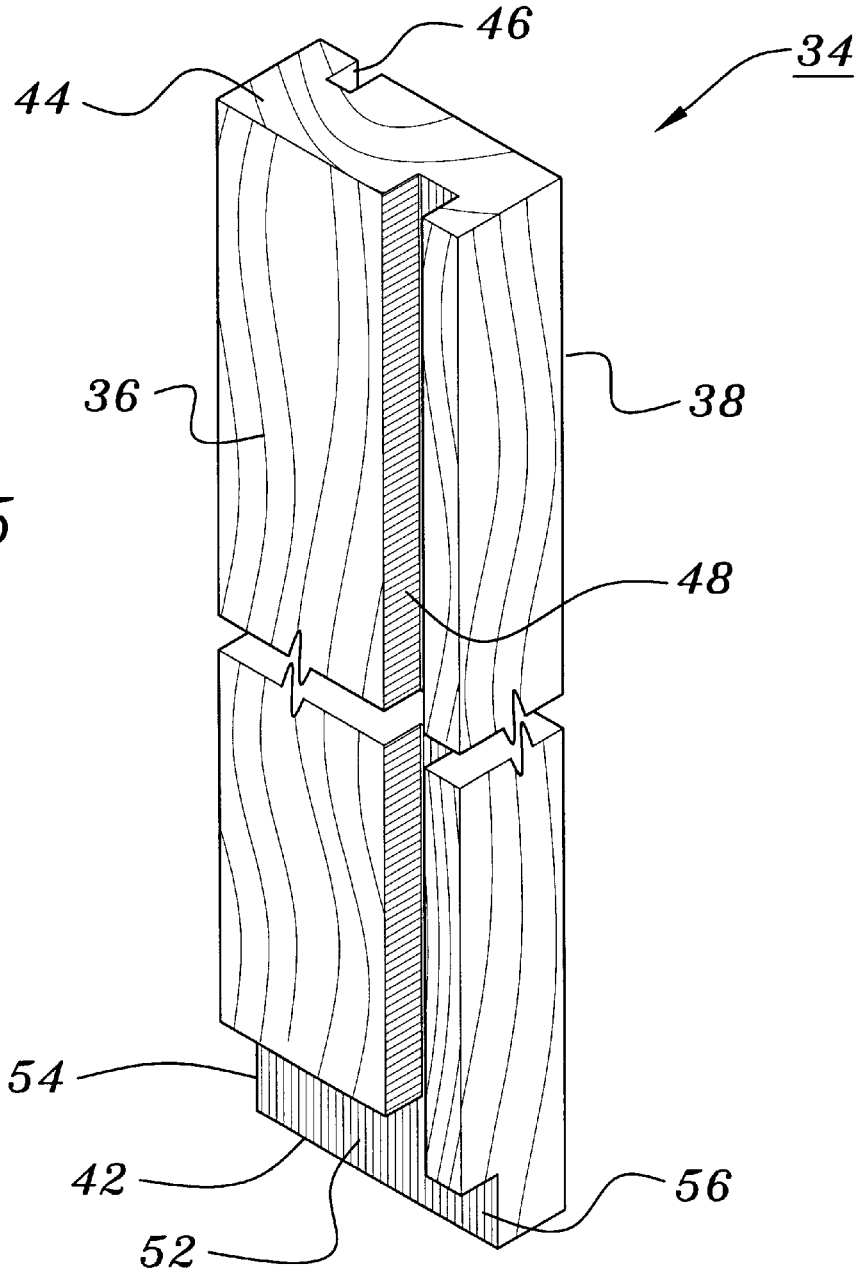
FIG. 5 is a perspective view of one assembly piece of the system.

FIGS. 4–5 illustrate one of the assembly pieces 34 employed in the system of the present invention. All of the assembly pieces of the system are identical, thus only one will be described in detail. The assembly piece 34 is defined by inner and outer surfaces (36 and 38 respectively) and first and second ends (42 and 44 respectively). Furthermore, a series of scarf joints are formed within the assembly piece 34. Specifically, a first scarf joint 46 is formed proximate a rearward edge of the piece and runs the length of the outer surface 38. Similarly, a second scarf joint 48 is formed proximate a forward edge of the piece and runs along the length of the inner surface 36. In the preferred embodiment, the second joint 48 is slightly larger than the first 46. With continuing reference to FIGS. 4–5, the transverse scarf joint 52 ofthe assembly piece is depicted. This joint 52 is formed perpendicular to the second scarf joint 48 and runs the entire width of the first end 42. In the preferred embodiment, the transverse scarf joint 52 has first and second extents (54 and 56 respectively) of differing heights. In other words, one side of the second scarf joint 48 runs longer than the other. The elongated side of the second scarf joint 48 is adapted to be interconnected with scarf joint 32 of fastening piece 20.

The assembly piece 34 has preferred nominal dimensions of 2 inches in height; 4 inches in width; and 8 feet in depth. The preferred dimensions of the scarf joints are as follows: first scarf joint 46 is formed ½ inch from the rearward edge and has a width of 5⁄16 inch and a height of ½ inch. The second scarf joint 48 is formed ½ inch from the forward edge and has a width of 9⁄16 inch and a height of ½ inch. Finally, transverse scarf joint 52 is formed at the lower end and has a first height of 1½ inch and a second height of 1 inch. Again, assembly pieces of differing dimensions, containing scarf joints of differing dimensions, can readily be employed within the system of the present invention.

Figure 10:
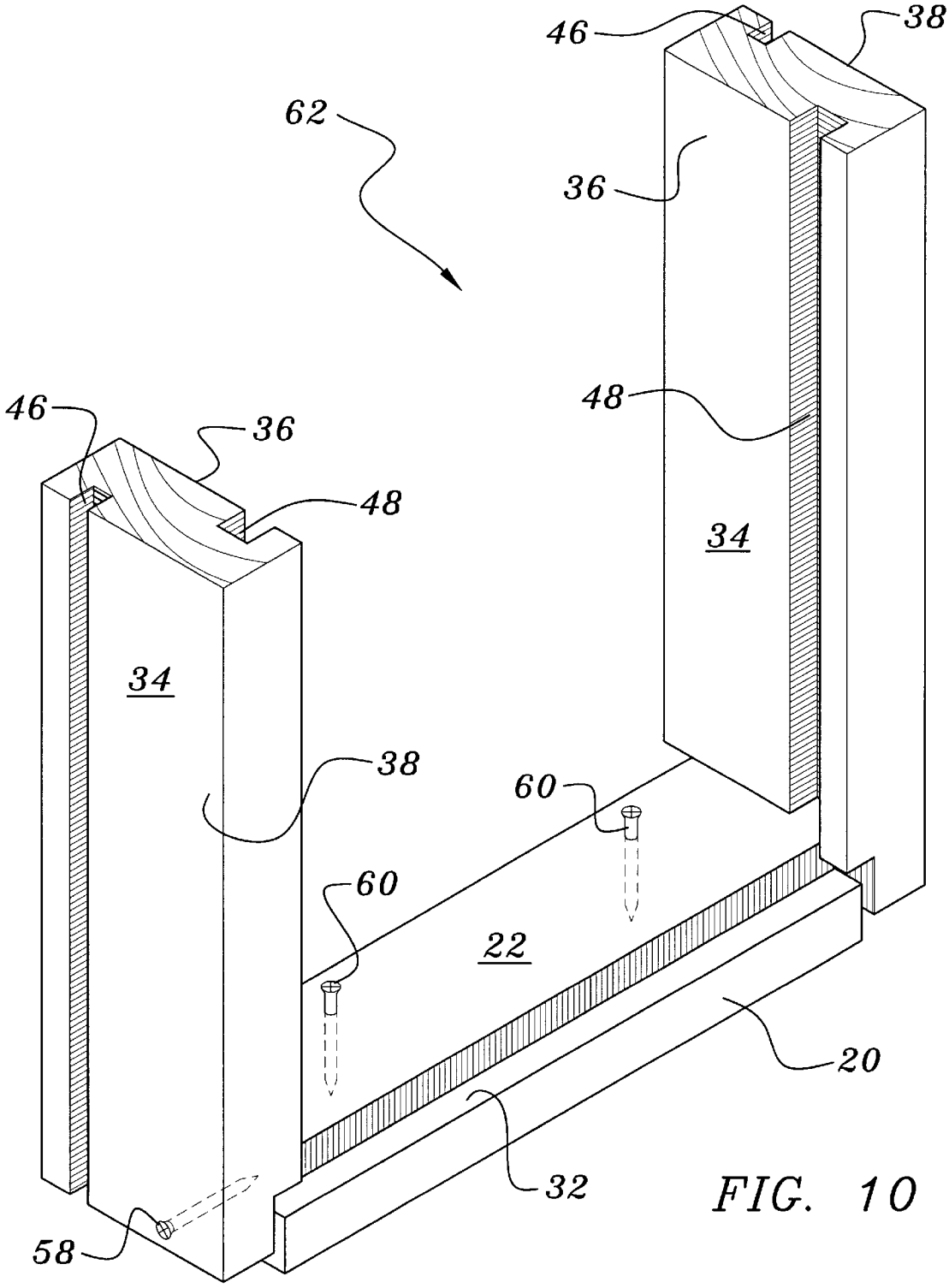
FIG. 10 is a perspective view of a partially constructed modular unit.

FIG. 10 illustrates the manner in which the assembly pieces are interconnected to opposing sides of fastening piece 20. Specifically, the transverse scarf joint 52 of the first assembly piece 34 is interconnected to the first end 26 of fastening piece 20. Likewise, the transverse scarf joint 52 of the second assembly piece 34 is interconnected to the second end 28 of fastening piece 20. Adhesives and bolts 58 are preferably utilized to couple the assembly pieces to the fastening piece. Furthermore, anchoring bolts 60 can be employed to secure the fastening piece 20 to the ground, or to an adjoining building module. After the assembly pieces 34 are connected, the U-shaped building module 62 depicted in FIG. 10 is achieved.

Figure 6:
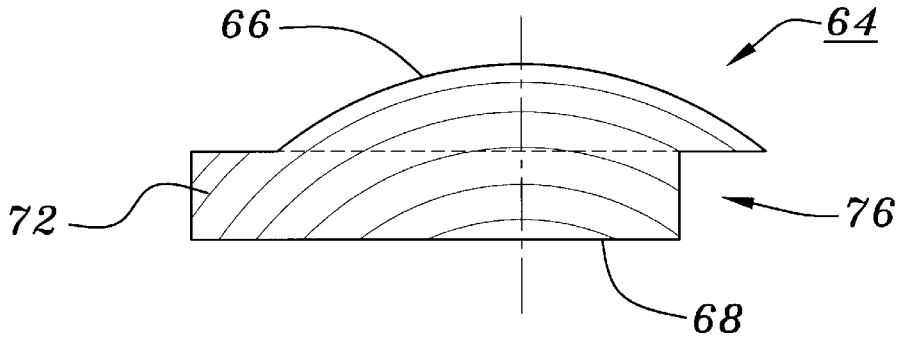
FIG. 6 is an elevational view of one panel of the system.
Figure 7:
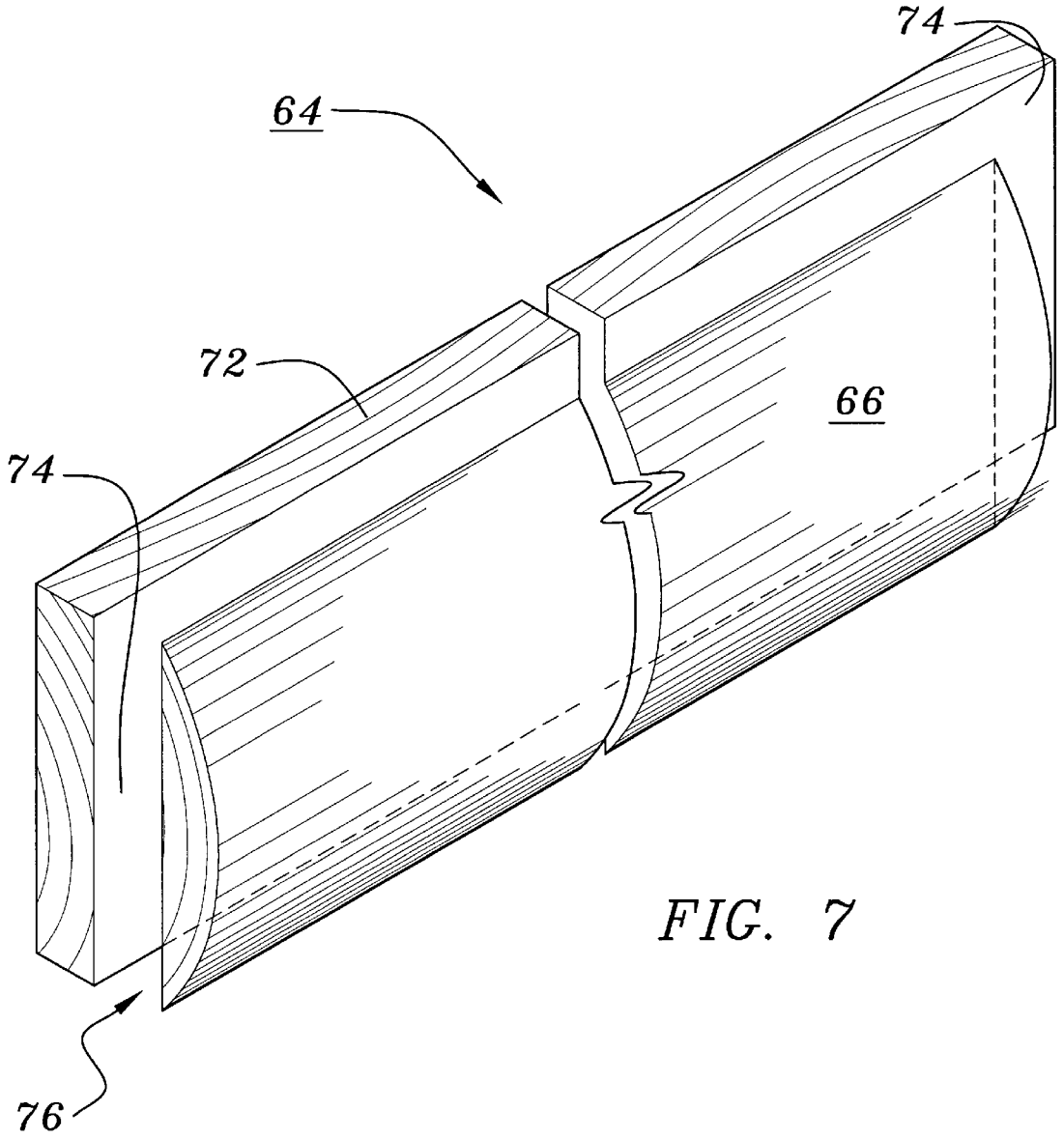
FIG. 7 is a perspective view of one panel of the system.

The U-shaped building module 62 is adapted to receive a series of panels 64. Each of the panels 64 are of an identical construction, thus only one will be described in detail. The panel 64, depicted in FIGS. 6–7, is defined by a rounded forward surface 66 and a planar rearward surface 68. The rounded surface 66 preferably takes a log like appearance. Furthermore, panels 64 include upstanding upper 72 and side edges 74, as well as a lower scarf joint 76. The panel 64 is preferably 2¾ inches in height and 2 feet 11 inches in depth. Furthermore, the upstanding upper edge 72 is preferably 7/16 inches in height and ½ inch wide. Similarly, the scarf joint 76 is preferably 7/16 inches in height and ½ inch wide. Again, panels of differing dimensions can be employed within the system.

Figure 11:
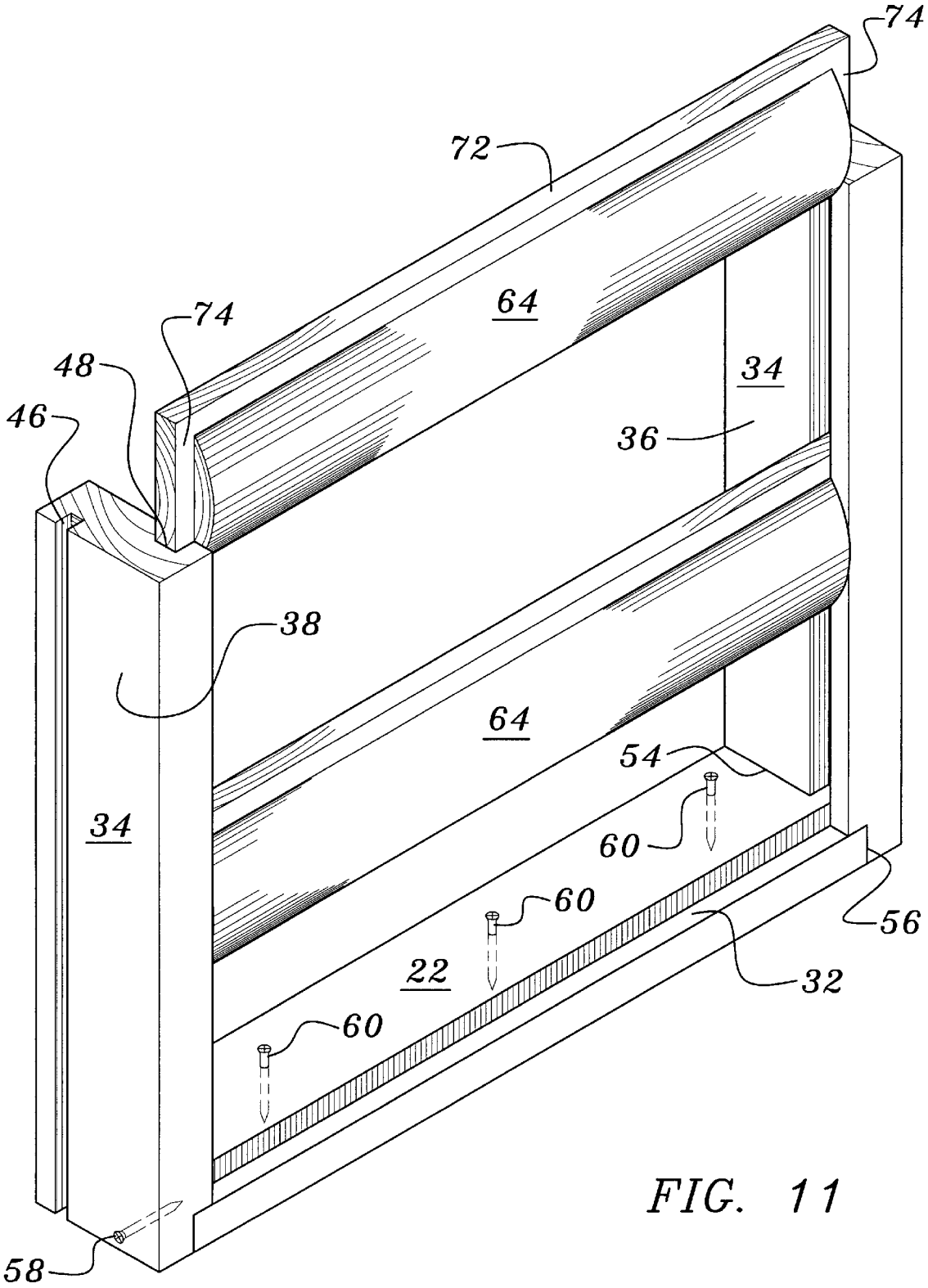
FIG. 11 is a perspective view of the partially constructed modular unit receiving a number of panels.

With reference now to FIG. 11, each of the panels 64 is slid in between the first and second assembly pieces 34 with the upstanding side edges 74 being received within the second scarf joints 48 of the assembly pieces 34. Furthermore, scarf joint 76 of the first panel 64 within the module 62 fits into the scarf joint 32 of fastening piece 20. The scarf joint 76 of the second panel 64, in turn, fits over the upstanding upper edge 72 of the lower panel 64. These interconnections create a fluid tight seal between adjacent panels without the need for adhesives, nails or bolts. Furthermore, the adjacent panels give a log cabin appearance to the finished dwelling.

Figure 13:
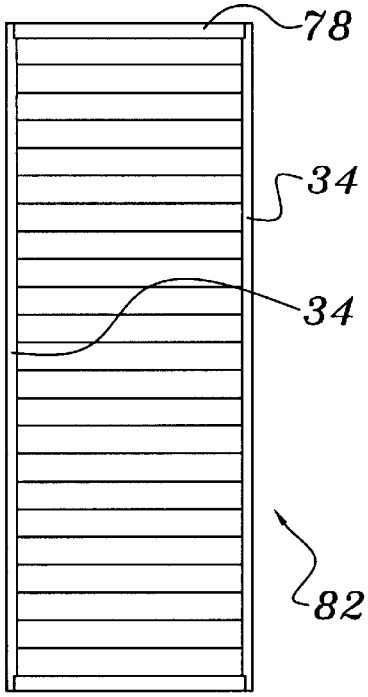
FIG. 13 is a view of a completed modular unit.

The building module is completed by securing a second fastening piece 78 to the second ends 44 of the first and second assembly pieces 34. As can be appreciated, the scarf joint of the second fastening piece 78 is positioned over the upstanding edge of the uppermost panel. With the series of panels 64 secured between the first and second assembly pieces 34 and the first and second fastening pieces 20, 78 a building module 82 is completed, note FIG. 13. FIG. 1 illustrates a completed dwelling 10 formed from various building modules 82. Furthermore, FIGS. 17–21 illustrate other possible building module configurations. These configurations are achieved by employing angled upper panels and fastening pieces. Such modules find particular application adjacent gabled roofs.

Figure 14:
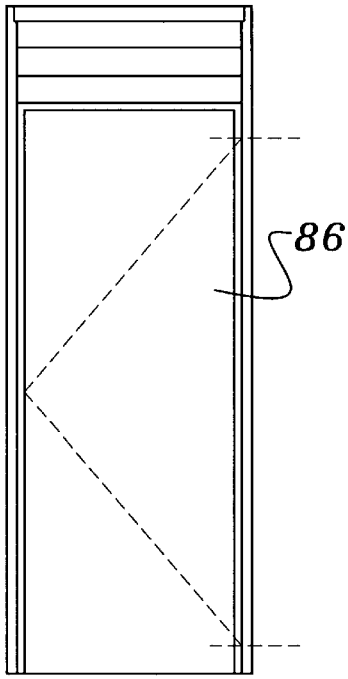
FIG. 14 is a view of a modular unit containing a door frame.
Figure 15:
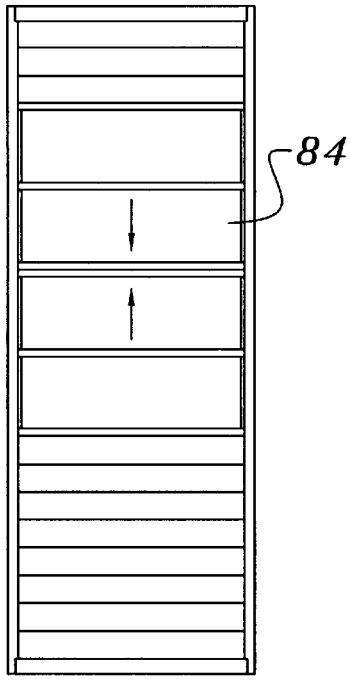
FIGS. 15–16 are views of modular units containing windows.
Figure 16:
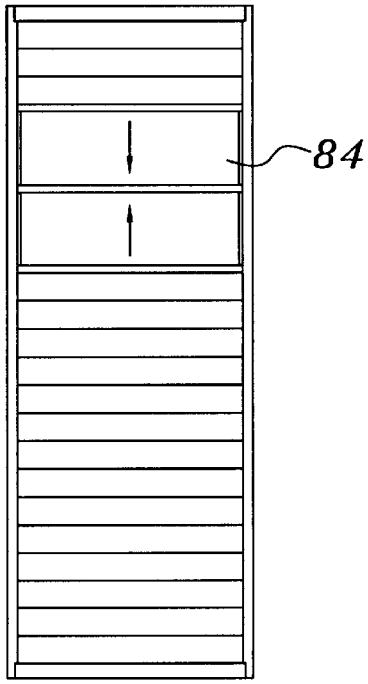
Figure 17:
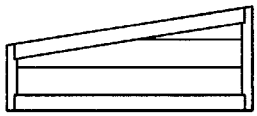
FIGS. 17–21 are elevational views of various modular unit shapes that can be employed in the system of the present invention.
Figure 18:
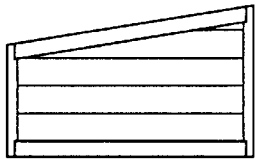
Figure 19:
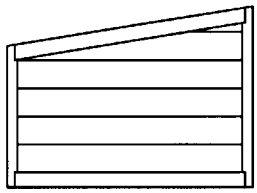
Figure 20:
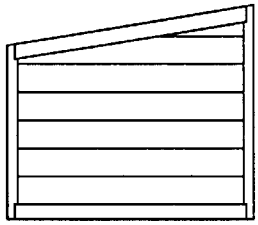
Figure 21:
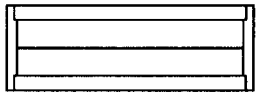

The U-shaped modular unit 62 can accept other structural elements such as windows and doors. FIGS. 15–16 illustrate window frames 84 which have been slid into positioned within the scarfs of the opposing assembly pieces. In the preferred embodiment, these are plastic or aluminum fixed glass guillotine windows. FIG. 14 illustrates a door frame 86 similarly positioned between the first and second assembly pieces. In this manner, a user can selectively position various doors and windows in the final completed dwelling.

Figure 8:
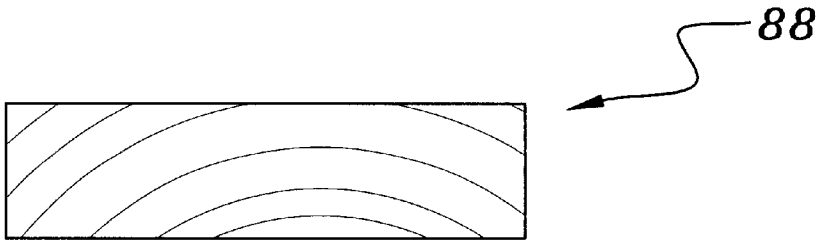
FIG. 8 is an elevational view of one joining piece of the system.
Figure 9:
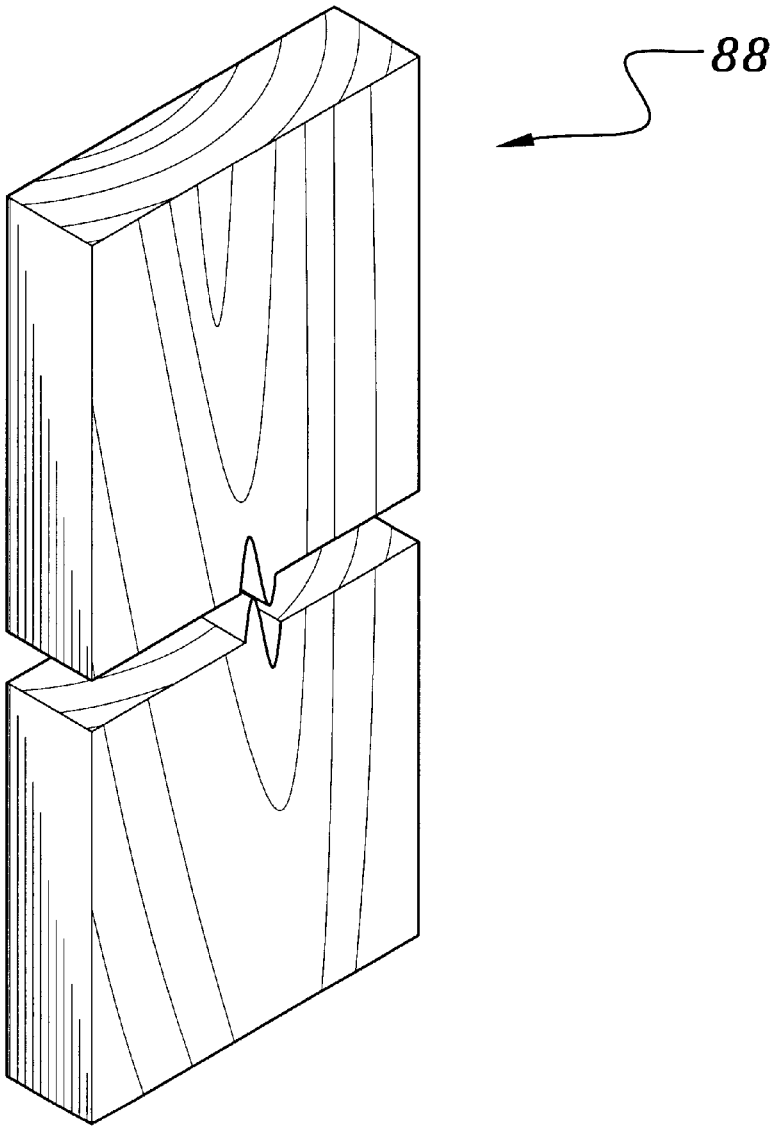
FIG. 9 is a perspective view of one joining piece of the system.
Figure 12:
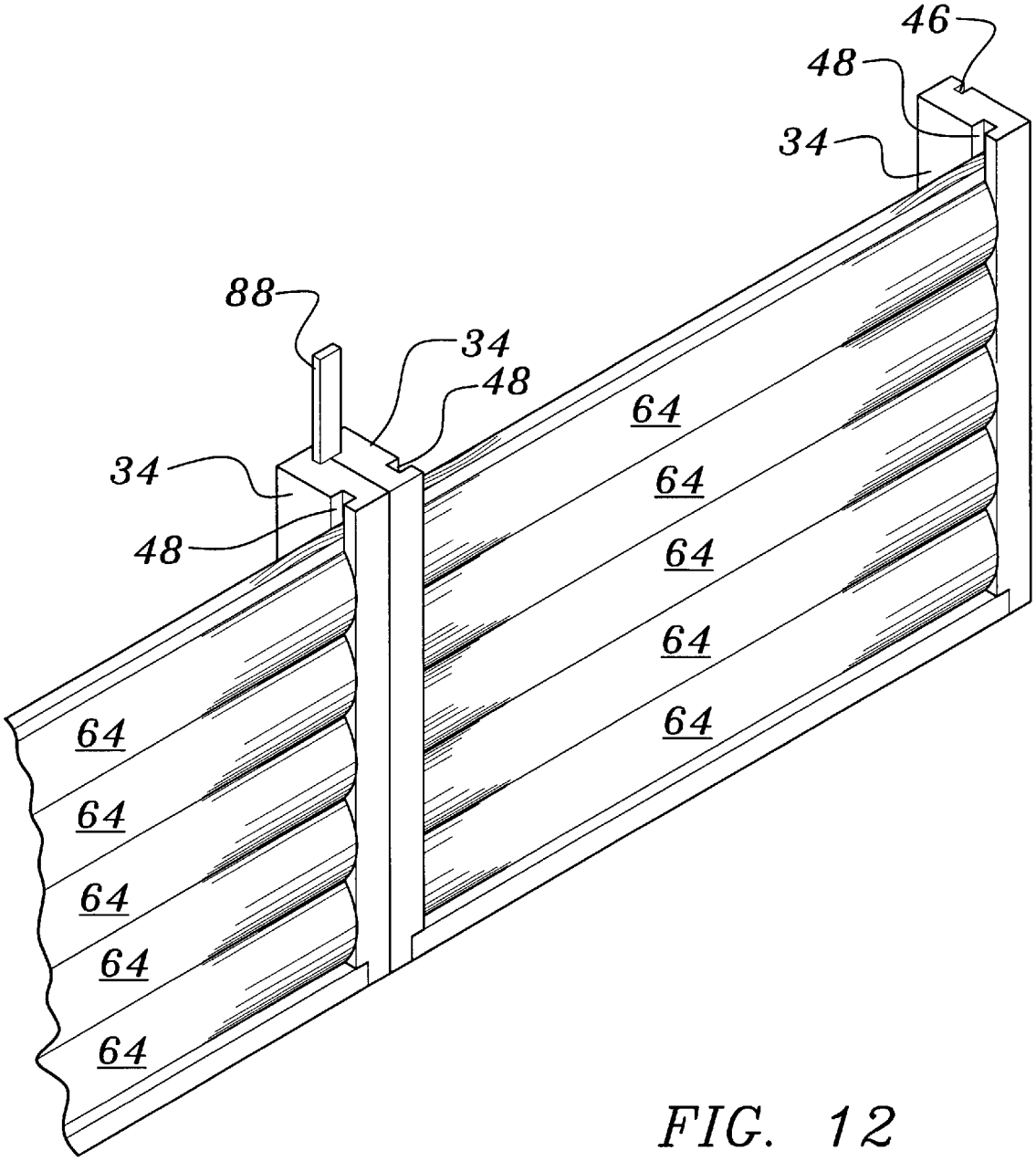
FIG. 12 is a perspective view of a series of panels interconnected with one another.

Adjacent modular units are interconnected by way of elongated joining pieces 88. The joining pieces are identical in construction, so only one will be described in detail. FIGS. 8–9 illustrate the joining piece 88 of the present invention. The piece is dimensioned to fit into the first scarf joint 46 of the assembly piece 34. In the preferred embodiment, the joining piece has nominal dimensions of 1 inch in height; 5/16 inches in width and 8 feet in depth. Obviously, other joining pieces employing other dimensions are within the scope of the present invention. Each joining piece should be sufficiently wide enough to be secured within the facing first scarf joints 46 of adjacent assembly pieces 34. In the preferred embodiment, the joining pieces are secured in place by way of an adhesive. FIG. 12 illustrates the manner in which a joining piece is employed in coupling adjacent modular units.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A modular building system employing interlocking building elements for use in constructing dwellings, the system comprising in combination:

a fastening piece having first and second surfaces, and first and second ends, a scarf joint formed within a forward edge and running the entire length of the first surface;

first and second assembly pieces, each of the assembly pieces having inner and outer surfaces, and first and second ends, a first scarf joint formed proximate a rearward edge and running the length of the outer surface, a second scarf joint formed proximate a forward edge and running the length of the inner surface, a transverse scarf joint formed perpendicular to the second scarf joint and running the entire width of the first end, the transverse scarf joint having first and second extents of differing widths, the transverse scarf joint of the first assembly piece being interconnected to the first end of the fastening piece, the transverse scarf joint of the second assembly piece being interconnected to the second end of the fastening piece;

a series of panels, each of the panels having a rounded forward surface, a planar rearward surface, upstanding upper and side edges, and a lower scarf joint, each of the panels being slid in between the first and second assembly pieces with the upstanding side edges being received within the second scarf joints of the assembly pieces and with the upstanding upper edge of each panel being positioned within the scarf joint of the adjacent panel to create a fluid tight seal between adjacent panels;

a second fastening piece being secured to the second ends of the first and second assembly pieces with the series of panels secured therebetween, the first and second assembly pieces, the first and second fastening pieces, and the series of panels forming a modular unit;

an elongated joining piece being secured within the facing first scarf joints of adjacent assembly pieces to permit the coupling of adjacent modular units.

2. A modular building system for use in constructing dwellings, the system comprising:

a fastening piece having first and second surfaces, and first and second ends, a scarf joint formed within a forward edge;

first and second assembly pieces, each of the assembly pieces having inner and outer surfaces, and first and second ends, a first and second scarf joints, a transverse scarf joint formed perpendicular to the second scarf joint, the transverse scarf joint of the first assembly piece being interconnected to the first end of the fastening piece, the transverse scarf joint of the second assembly piece being interconnected to the second end of the fastening piece;

a series of panels, each of the panels having upstanding side edges, and each of the panels being slid in between the first and second assembly pieces with the upstanding side edges being received within the second scarf joints of the assembly pieces.

3. The system as described in claim 2 wherein each of the panels includes a lower scarf joint and an upper edge which allows adjacent panels to be coupled in a fluid tight manner.

4. The system as described in claim 2 wherein each of the panels includes a rounded forward surface such that a series of panels creates a log cabin appearance.

5. The system as described in claim 2 wherein each transverse scarf joint is formed of two extents of differing widths with one extent adapted to be coupled to the scarf joint of the fastening piece.

6. The system as described in claim 2 wherein the first and second assembly pieces, fastening piece, and series of panels from a modular unit.

7. The system as described in claim 6 further comprising an elongated joining piece secured within the facing first scarf joints of adjacent assembly pieces to permit the coupling of adjacent modular units.

8. The system as described in claim 2 further comprising a window frame slidably positioned intermediate adjacent panels.

9. The system as described in claim 2 further comprising a door frame slidably positioned within the opposing second scarf joints of the first and second assembly pieces.

* * * * *